US006612935B2

(12) United States Patent
Rojahn

(10) Patent No.: US 6,612,935 B2
(45) Date of Patent: Sep. 2, 2003

(54) APPARATUS FOR GENERATING LIGHT EFFECTS

(76) Inventor: Johannes Rojahn, Schweinfurthstr. 84, 14195 Berlin (DE)

( * ) Notice: Subject to any disclaimer, the term of this patent is extended or adjusted under 35 U.S.C. 154(b) by 0 days.

(21) Appl. No.: 10/097,569

(22) Filed: Mar. 15, 2002

(65) Prior Publication Data

US 2003/0027643 A1 Feb. 6, 2003

(30) Foreign Application Priority Data

Mar. 15, 2001 (DE) ..... 101 14 048

(51) Int. Cl.[7] ..... A63J 5/02
(52) U.S. Cl. ..... 472/61; 472/65; 40/406
(58) Field of Search ..... 472/57, 61, 64, 472/65, 67, 72; 40/906, 406, 407, 408, 427, 429, 431

(56) References Cited

U.S. PATENT DOCUMENTS 4,985,811 A * 1/1991 Weiner ..... 362/101
5,916,030 A * 6/1999 Warner ..... 472/65
5,951,405 A * 9/1999 Eigenmann ..... 472/61
6,168,531 B1 * 1/2001 Adamson et al. ..... 472/61
6,270,420 B1 * 8/2001 Lee ..... 472/67
6,385,881 B1 * 5/2002 Hess ..... 40/428

* cited by examiner

*Primary Examiner*—Kien T. Nguyen
(74) *Attorney, Agent, or Firm*—Birch, Stewart, Kolasch & Birch, LLP

(57) ABSTRACT

An apparatus for generating light effects comprising a liquid container having transparent top and bottom walls, partially filled with a transparent liquid. At least one light source is mounted so that an emitted light beam will pass through the liquid container at the top and bottom walls thereof to project an image on a desired surface. An actuator including a control unit is effectively coupled directly or though a transmission medium with the liquid container such that the movements generated in a given pattern impart vibrations to the liquid in the liquid container.

13 Claims, 4 Drawing Sheets

APPARATUS FOR GENERATING LIGHT EFFECTS

This invention relates to apparatus for generating light effects.

It has been known to utilize a wide variety of light effects for aesthetic presentations or for influencing human well-being. For example, certain colors and abstract light patterns have a relaxing effect and are used accordingly in support of psychotherapeutic treatments or relaxation techniques. The action light effect of this kind exert on the human mood may be enhanced markedly by combining it with the playing back of acoustic signals, and especially music. For these reasons, these elements are used regularly in discotheques, concerts or other public performances as incidental to the music being performed; they are projected on available projection screens or surfaces or are scattered from reflectors composed of a multiplicity of individual facettes.

In systems of this kind, the light images obtainable are limited in variety as existing structures and the type of drive permit only a limited number of states to be obtained.

Document WO 88/05685 teaches a device for generating light effects which may be affected in dependence on a speaker signal. In this solution, the device has two apertured disks located along the beam path of a light source. One of the disks is driven in rotation and is coupled through suitable actuating means with a speaker cone so that vibrations thereof may be transmitted to the rotating disk. The actuating means comprises an entrainment member frictionally engaging the rotating apertured disk to impart movements thereto in accordance with the vibrations the speaker performs in operation. Drawbacks of this solution are its limited variability regarding the light patterns it can generate and the transmission mechanism, which is complex and thus susceptible to malfunction.

Document DE 39 22 661 A1 discloses an optokinetic device intended to generate abstract colored images. To this end, a housing having transparent side walls has therein a light source the light of which is bundled at least partly for impingement on the transparent side walls after at least one reflexion within the housing. The bottom wall of the housing is covered with a fluid maintained in a state of commotion by means of a wave generator. Also, plural optical elements having dispersing and/or collecting properties are movably mounted above the fluid. In its entirety, this assembly is supposed to reflect, disperse and bundle the light several times to as to generate playful light patterns for projection on a ground-glass screen. Despite its complex construction, the assembly generates little more than blurred light patterns of restricted variety.

It is the object of the invention to provide apparatus of the aforesaid kind which enables abstract light effects of great variety to be generated on a projection surface in a simple and inexpensive way.

This object is attained by apparatus as defined in claim 1 and specifically by apparatus comprising a liquid container having transparent top and bottom walls, which container is filled partly with a transparent liquid, and further comprising at least one light source disposed so that a light beam emitted thereby emerges from the liquid container through the top and bottom walls and is imaged on a desired projection surface, as well as an actuator having a control unit, said actuator effectively coupled to the liquid container directly or through transmitting media to perform movements generated in accordance with a prescribable pattern which imparts vibration to the fluid in the liquid container.

These measures enable pleasing and highly variable light effects to be generated with little design complexity and expense. The top surface of the fluid causes the light passing therethrouugh to be refracted in accordance with an existing wave pattern, angle of incidence and refractive index—all of them reflected in the appearance of the resultant light effect.

In alternative embodiments, it is contemplated to use instead of an actuator imparting vibrations to the liquid container an actuator directly acting upon such liquid—e.g. by being immersed in it. Further, the bottom wall of the liquid container may have a reflective metal coating thereon. In that case, the light source is disposed so as to illuminate the liquid container at an angle from the top, for example, causing the light to be transmitted through the moving liquid surface and to impinge on the container bottom to be reflected thereby.

In another preferred embodiment of the invention, the aesthetic presentation of the light effects, which basically is independent, is coupled to the reproduction of acoustic signals. To this end, the control unit includes means for converting acoustic or electroacoustic signals to patterns of movement the-actuator is intended to perform. Actuator movements affect the formation of the wave pattern of the fluid surface and thus, ultimately, the appearance of the light effects.

The control unit is coupled preferably with acoustic playback equipment of which the playback performance determines the actuator's pattern of movement. Accordingly, the assembly—if connected to a hi-fi stereo—may be used readily in discotheques or in a user's home.

In this connection, the control unit is designed preferably to have an input impedance compatible with conventional music playback equipment, such as preamplifiers or power amplifiers. Preferably the control unit includes means for matching its input impedance to the output impedance of the signal source.

Preferably the actuator comprises an electromagnetic transducer similar in structure to a loudspeaker with an electric vibrating coil. A speaker cone is not required if the coil or an armature driven by a stationary coil is connected directly with a drive for the liquid container or with an oscillating member immersed in the liquid.

The actuator control unit preferably includes a bandpass or lowpass filter dimensioned to excite the fluid in the container to perform oscillations in a desired and effective frequency band. Alternatively, the actuator itself may be designed and constructed to have bandpass or lowpass properties.

Conversion of the acoustic or electroacoustic signals input to the control unit to obtain actuator control signals is performed preferably in a manner such as to generate standing waves in the fluid. The resultant light effects are characterized by a pregnant and high-contrast appearance. Additional aesthetic effects can be obtained by optical auxiliary elements for deflecting, focussing or prismatically splitting the light beam.

The actuator may also comprise a speaker set up so that the movements of its cone are transmitted to the liquid container using the ambient air as a transmission medium. As a result, the system may be integrated in available speaker enclosures to at least partly replace one of the walls thereof.

In an alternative variant, the actuator comprises the speaker enclosure itself. In this case, at least the liquid container is attached to the speaker enclosure by suitable means such that its operating vibrations are transmitted to the fluid. In the aforesaid preferred embodiments, no complex electronic control of the light effects is necessary—simple acoustic or mechanic coupling will be sufficient.

In another preferred embodiment of the invention, the actuator is effectively coupled with the side walls and/or the bottom wall of the liquid container. In that case, the actuator may specifically comprise an electric drive the movements of which may be transmitted directly to the liquid container. In an alternative variant of the invention, the actuator movements are passed on by means of pull wires attached to the bottom wall of the liquid container and to the actuator. This allows the actuator to be adapted to the requirements of each individual application with a high degree of variability.

Additional advantageous measures are described in the dependent claims. The invention is shown in the attached drawings and described in greater detail hereinbelow.

FIG. 1 schematically shows the inventive apparatus for generating light effects;

Figure 6:
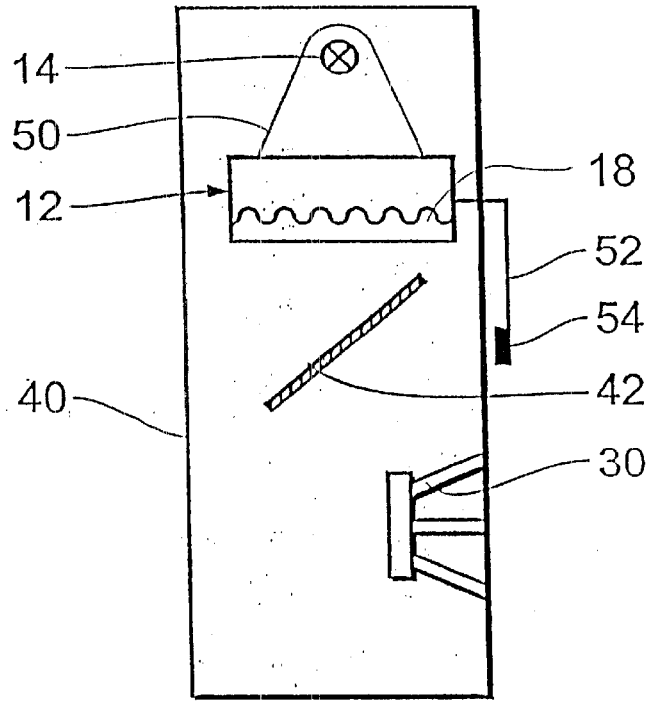
Figure 7:
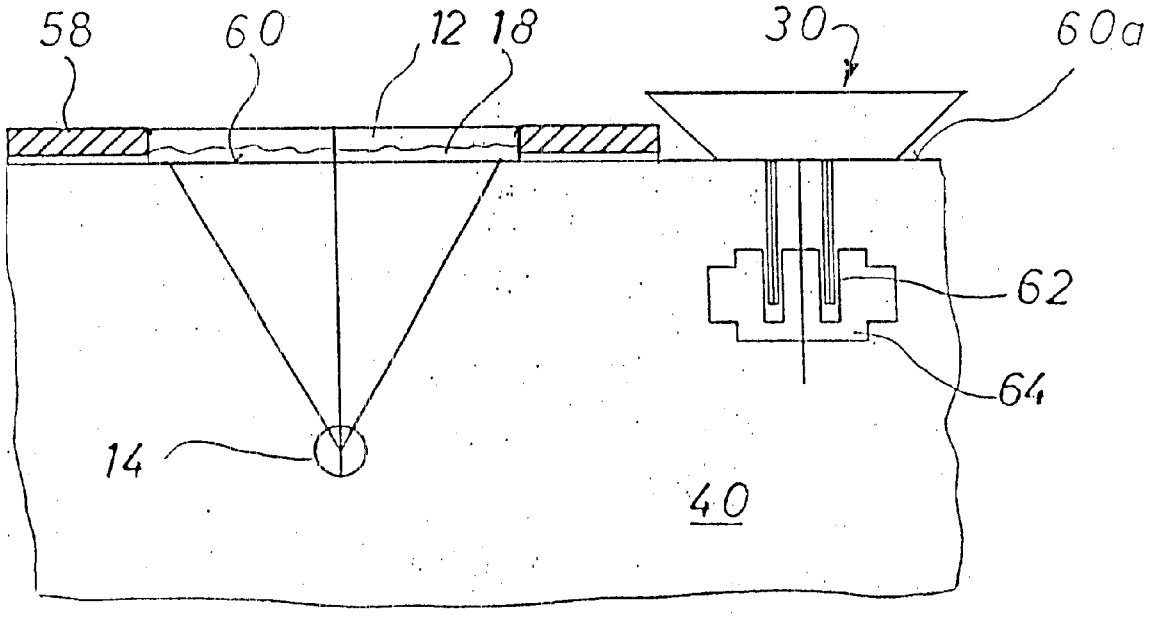

FIG. 6 a sectional view of a fifth embodiment using a conventional speaker enclosure;

FIG. 7 a sectional view of an embodiment using a one-piece continuous membrane which constitutes a liquid container wall as well as the oscillating membrane of a speaker and which is at least partly transparent.

Figure 1:
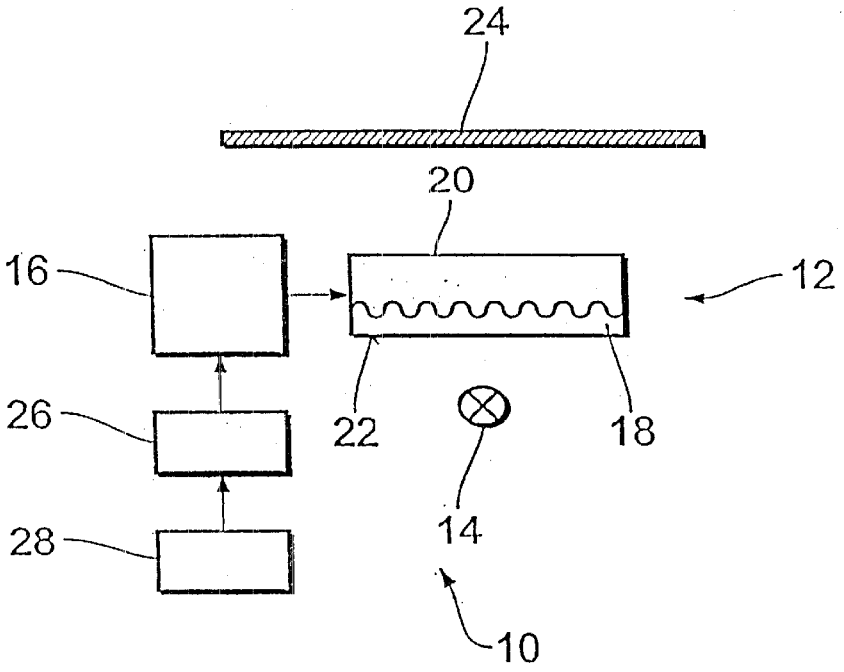

Apparatus 10 schematically shown in FIG. 1 is designed to generate light effects. To this end, apparatus 10 comprises at least one liquid container 12, a light source 14 and an actuator 16. Liquid container 12 is filled at least partly with a transparent liquid such as water and sealed to be air-tight. Top and bottom walls 20, 22 of liquid container consist of a transparent material such as acrylic, glass or a plastic foil. The dimensions of liquid container 12 can be selected freely to accommodate any individual application.

Light source 14 is arranged so that the light it emits passes through liquid container 12 at top wall 20 and bottom wall 22 to strike a projection surface 24. Of course, additional optical elements may be provided for deflecting, focussing or prismatically splitting the light. Such optical aids are known from prior art so that it will be unnecessary to discuss them here.

Actuator 16 is coupled effectively with liquid container 12 so that movements of actuator 16 are transmitted to liquid container 12. Assuming the actuator's operating frequency to be properly chosen, resonances may be achieved which result in the formation of standing waves in liquid 18. In its position of use, liquid container 12 should be oriented to be approximately horizontal so that liquid 18 assumes a substantially uniform depth, whereby light source 14 can emit its light approximately normally through the liquid.

A control unit 26 may be used to get actuator 16 to generate such oscillation patterns in a well-directed manner. The light passing through liquid 18 reproduces the appearance of such wave patterns on projection surface 24 due to the refraction thereof at the phase boundary between liquid 18 and the air.

Control unit 26 may be coupled to acoustic playback apparatus 28. For example, it is envisioned to couple control unit 26 to a suitable output of a stereo system. The control unit evaluates the signal input and converts them to control signals for actuator 16. In this manner, apparatus 10 may be used to provide optical effects incidental to a music performance.

Figure 2:
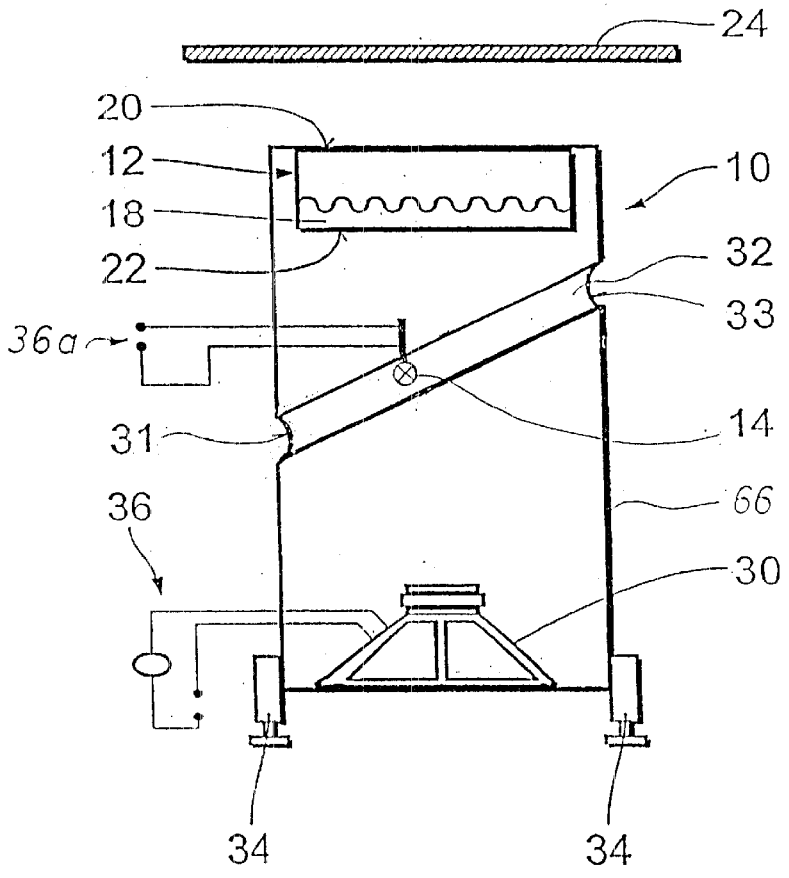
FIG. 2 shows a sectional view through a first variant of the invention using a speaker as an actuator.

FIG. 2 schematically shows a section through a first variant of apparatus 10 which uses a tubular hollow cylinder 66. In this case, actuator 16 comprises a speaker 30 of which the operating vibrations are transmitted through air to liquid container 12. Hollow cylinder 66 may in fact comprise the enclosure of speaker 30.

Tubular hollow cylinder 66 has therein a cooling tube 32, with light source 14 mounted approximately midway along said tube. Cooling tube 32 is open at both ends and is upwardly slanted inside hollow cylinder 66. Its lower end constitutes an air inlet opening 32 and its other end an air outlet opening 33 situated on a higher level.

The upwardly slanted orientation of cooling tube 32 causes heat released by light source 14 in the operation thereof to develop an upward air current which exerts a cooling effect. The chimney effect causes cool ambient air to be attracted and heated air to be discharged upwardly. Inside cooling tube 32 the air density will be substantially uniform, which results in constant resonant properties of the transmission media, namely, the air.

Light source 14 has a voltage source 36*a* associated therewith which is adapted to be controlled to vary the brightness thereof. Transparent top wall 20 of liquid container 12 may have associated therewith a mirror (not shown and described in detail) to re-direct the exiting light effects onto laterally disposed projection surfaces 24. Bottom wall 22 of liquid container 12 may be designed to be a transparent membrane.

Because of its transmission mechanism, apparatus 10 should be sealed to be air-tight. Tubular hollow cylinder 66 may be mounted on feet 34 which are adjustable in order to vary and enhance the playback properties of speaker 30 as desired, on the one hand, and in order to adjust the top surface of transparent liquid 18 in container 12 to a uniform horizontal orientation, on the other.

Speaker 30 has associated therewith a controllable voltage source 36 which is part of the control unit 26 schematically shown in FIG. 1. Source 36 may be interfaced to any playback set 28 (shown schematically only). Control unit 26 may include a lowpass filter for converting the signals provided by playback set 28 to account for the transmission properties of air.

Figure 3:
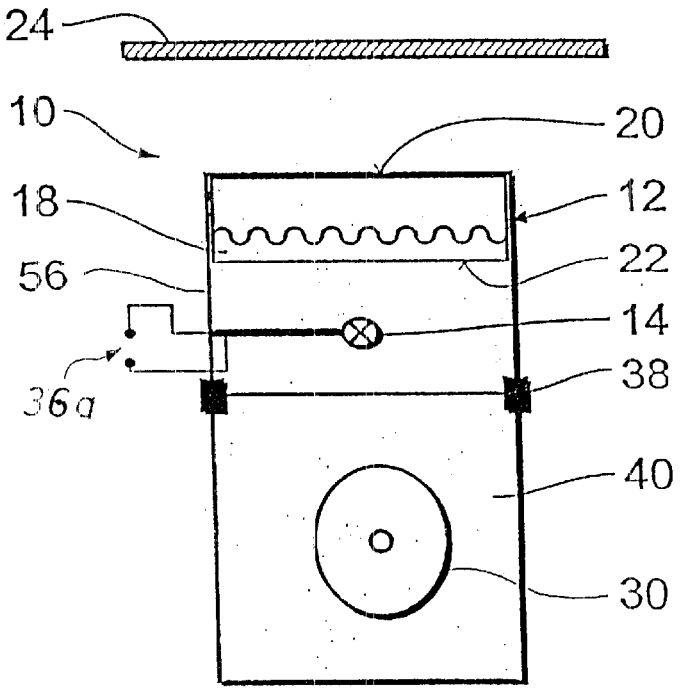
FIG. 3 shows a sectional view through a second variant of the invention using a speaker enclosure as an actuator.

FIG. 3 schematically shows another simplified embodiment of apparatus 10. In this case, liquid container 1 and light source 14 are integrated in a common frame 56. Frame 56 is fixedly attached to speaker enclosure 40 by suitable holding means 38. Light source 14 is coupled to a controlled voltage source 36*a*.

The operation of speaker enclosure 40 causes vibrations to be generated which are transmitted to frame 56 and thus to fluid container 12. In this case, speaker enclosure 40 also serves as an actuator.

Figure 4:
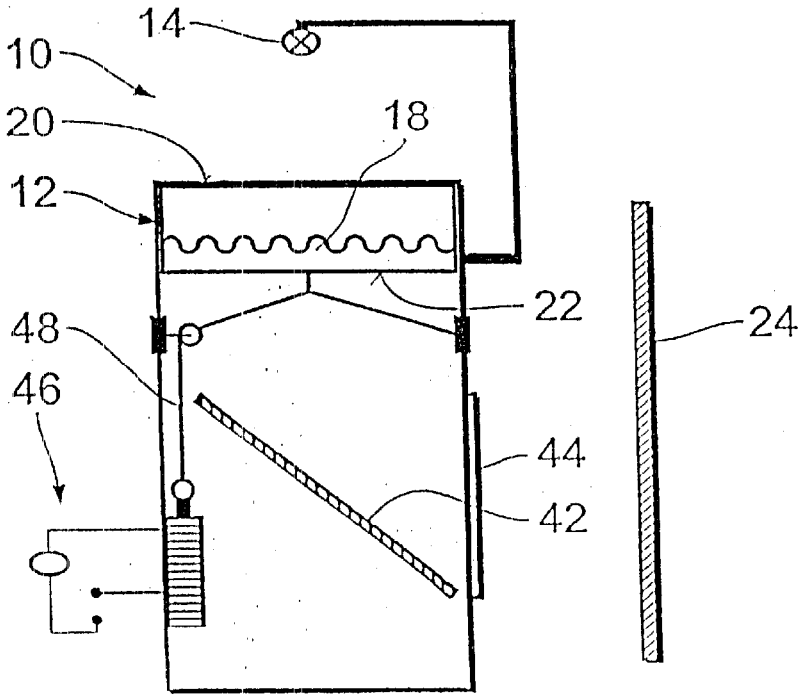
FIG. 4 shows a sectional view through a third variant of the invention using an electric drive as an actuator.

Another variant of apparatus 10 is shown in FIG. 4. The direction of transmission of light source 14, which is mounted to lie above liquid container 12 now, is inverted in this case. In other words: the light is transmitted from the top down through top wall 20 of liquid container 12. Thereafter, it is deflected by a reflector 42 to emerge from apparatus 10 through a lateral window 44.

In this embodiment, an electric drive system 46 is used as an actuator 26. Electric drive 46 and liquid container 12 are coupled to each other through pull wires 48 attached to the bottom of liquid container 12. Movements of electric drive 46 are thus transmitted to liquid 18. As an alternative to transmission path, actuator 26 may be designed to impart vibrations to the side walls of liquid container 12. To this end, it may be connected with such walls and may vibrate in a pattern prescribed by control unit 26.

Figure 5:
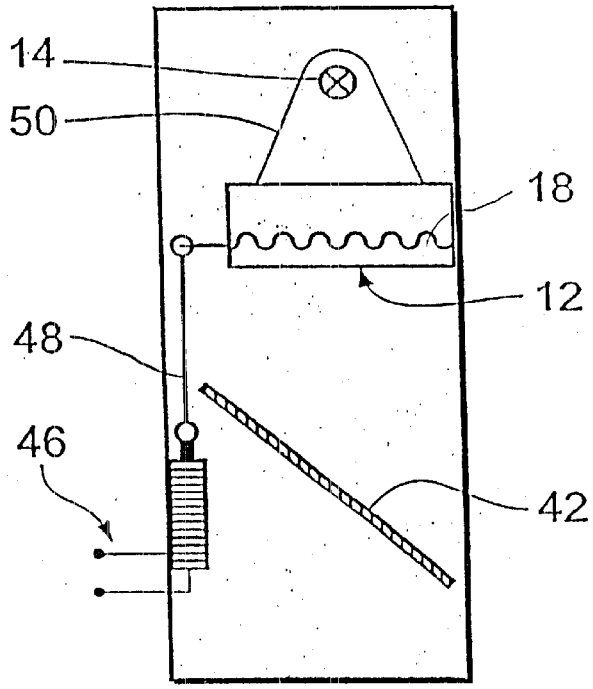
FIG. 5 shows a sectional view of an alternative embodiment similar to FIG. 4 with the liquid container mounted for swinging movements and a lateral movable joint.

In the variant shown in FIG. 5 of apparatus 10, liquid container 12 is suspended for swinging movements from ropes 50. Also, liquid container 10 has a pull wire 48 associated therewith, said pull wire deflected to horizontal and laterally attached to container 12. This way, swinging movements can be imparted to liquid container 12. Such lateral oscillations of liquid container 12—as generated by periodically driving electric drive 46—cause the liquid 18 in it to move correspondingly and to generate a corresponding wave pattern, which may be projected on the walls of a room by means of light source 14 and reflector 42.

FIG. 6 shows an embodiment which consists essentially of a liquid container 12 suspended from ropes 50 for swinging above a speaker 30. The radiation region of speaker 30 has therein a kind of sail or flag 54 coupled to liquid container 12 by a link 52.

As speaker 30 in enclosure 40 moves, it generates air currents which strike the sail or flag 54 and excite liquid container 12 via link 52 to perform lateral vibrations. Thus a wave pattern will form on the surface of liquid 18 in liquid container 12, which pattern may be projected on the walls of a room by means of light source 14 and reflector 42 as described above.

FIG. 7 shows an embodiment in which a continuous membrane 60 is connected integrally with cone 60*a* of a speaker 30. Membrane 60 at the same time constitutes a wall—preferably the bottom—of liquid container 12. Membrane 60 is transparent at least in the region of an aperture member 58 for the transmission of light from a light source 14 therebelow.

Membrane 60 of liquid container 12, which is integral with cone 60*a* of speaker 30, has associated therewith coils 62 guided to move within electromagnet 64. Varying the acoustic signals will cause the electric voltage applied to electromagnet 64 to vary and speaker cone 60*a* to vibrate.

Varying the electric voltage applied to electromagnet 64 will cause coils 62 to move, such movements imparted as vibrations to speaker cone 60*a* and from speaker cone 60*a* to membrane 60, which is integral therewith. As that membran 60 also constitutes the bottom wall of liquid container 12, the vibrations are imparted to the transparent liquid 18, causing wave patterns to develop at the surface of liquid 18, which light source 14 may project onto a projection surface not shown here in detail.

Reference Characters

10 apparatus
12 liquid container
14 light source
16 actuator
18 transparent liquid
20 transparent top wall of 12
22 transparent bottom wall of 12
24 projection surface
26 control unit
28 acoustic playback equipment
30 speaker
31 air inlet opening
32 cooling tube
33 air outlet opening
34 foot
36, 36*a* controlled voltage source
38 holding means
40 loudspaker enclosure
42 mirror
44 window
46 electric drive
48 pull wire
50 rope
52 link
54 flag
56 frame
58 aperture member
60 membrane
60*a* speaker cone
62 coil
64 magnet
66 hollow cylinder

What is claimed is:

1. An apparatus for generating light effects, comprising:

a liquid container having a transparent top wall and a transparent bottom wall, said container being partly filled with a transparent liquid;

at least one light source mounted so that an emitted beam of light passes through the liquid container at the top wall and at the bottom wall and is imaged onto a projection surface; and an actuator having a control unit, the actuator being effectively connected with the liquid container directly or through a transmission medium in such a manner that vibrations generated by the actuator will excite the liquid inside the liquid container to vibrate, the control unit including means for converting acoustic or electroacoustic signals into patterns of movement of the actuator.

2. The apparatus of claim 1, wherein the control unit is coupled with acoustic playback equipment, the playback of which determines the patterns of movement, and wherein the control unit includes a lowpass filter.

3. The apparatus of claim 1, wherein the control unit converts the acoustic or the electroacoustic signals into control signals for the actuator so that standing waves may be generated in the liquid.

4. The apparatus of claim 1, wherein auxiliary optical means are provided for deflecting, focusing, or prismatically splitting the light beam.

5. The apparatus of claim 1, wherein the actuator comprises a speaker having a cone, the speaker being mounted such that movements of the cone are transmitted to the liquid container.

6. The apparatus of claim 5, wherein a one-piece continuous membrane is connected with the cone, the one-piece membrane constituting a wall of the liquid container.

7. The apparatus of claim 6, wherein the membrane is transparent at least a region of the liquid container such that light from the light source is able to shine therethrough.

8. The apparatus of claim 1, wherein the actuator is effectively connected with at least one of side walls and the bottom wall of the fluid container.

9. The apparatus of claim 8, wherein movements of the actuator are transmitted by pull wires attached to the bottom wall of the liquid container, and wherein the actuator comprises an electric drive.

10. The apparatus of claim 1, wherein the actuator comprises a speaker enclosure, and the liquid container is secured to the top of the speaker enclosure by at least suitable holding means so that operating vibrations thereof may be transmitted to the transparent liquid.

11. The apparatus of claim 10, wherein the speaker enclosure forms a hollow cylinder, said hollow cylinder having therein an upwardly slanted cooling tube open at both ends, the light source being associated with the cooling tube.

12. The apparatus of claim 11, wherein the cooling tube has at one end an air inlet opening situated on a lower level and, at its other end, the cooling tube has an air outlet opening situated on a higher lever.

13. The apparatus of claim 11, wherein the light source is mounted inside the cooling tube.

* * * * *